US008297170B2

(12) United States Patent
Diller et al.

(10) Patent No.: US 8,297,170 B2
(45) Date of Patent: Oct. 30, 2012

(54) MODULAR, ADAPTABLE BALLISTIC PROTECTIVE CONSTRUCTION IN PARTICULAR FOR A WEAPONS TURRET

(75) Inventors: Armin Diller, Augsburg (DE); Jochen Kraus, Augsburg (DE)

(73) Assignee: Rheinmetall Landsysteme GmbH, Kiel (DE)

( * ) Notice: Subject to any disclaimer, the term of this patent is extended or adjusted under 35 U.S.C. 154(b) by 320 days.

(21) Appl. No.: 12/202,659

(22) Filed: Sep. 2, 2008

(65) Prior Publication Data

US 2009/0114085 A1 May 7, 2009

Related U.S. Application Data

(60) Provisional application No. 60/969,731, filed on Sep. 4, 2007.

(30) Foreign Application Priority Data

Aug. 31, 2007 (DE) ..... 10 2007 041 292

(51) Int. Cl.
*F41H 5/20* (2006.01)

(52) U.S. Cl. ..... 89/36.13; 89/36.08

(58) Field of Classification Search ..... 89/36.13, 89/36.08, 36.07, 36.12
See application file for complete search history.

(56) References Cited

U.S. PATENT DOCUMENTS

| | | | | |
|---|---|---|---|---|
| 1,483,987 A | | 2/1924 | Rockwell | |
| 1,693,460 A | | 11/1928 | Paulus et al. | |
| 2,284,488 A | | 5/1942 | Johnson | |
| 2,479,633 A | | 8/1949 | Mackenzie | |
| 2,625,859 A | | 1/1953 | Dandini | |
| 3,687,004 A | | 8/1972 | Faisandier | |
| 3,699,842 A | * | 10/1972 | Grewing et al. | 89/36.08 |
| 3,765,299 A | | 10/1973 | Pagano et al. | |
| 4,031,807 A | * | 6/1977 | Boyer | 89/36.13 |
| 4,036,104 A | * | 7/1977 | Pagano et al. | 89/36.08 |
| 4,114,512 A | * | 9/1978 | Schwendt | 89/36.13 |
| 4,125,052 A | | 11/1978 | Thomas | |
| 4,324,169 A | * | 4/1982 | Ruttgerodt | 89/36.14 |
| 4,351,558 A | | 9/1982 | Mueller | |
| 4,381,693 A | * | 5/1983 | Dumez | 89/36.13 |

(Continued)

FOREIGN PATENT DOCUMENTS

DE 10 98 412 1/1961

(Continued)

OTHER PUBLICATIONS

Office Action issued in corresponding German Application No. 20 2007 041 292.6-15 dated Feb. 18, 2009.

(Continued)

*Primary Examiner* — Michelle Clement
(74) *Attorney, Agent, or Firm* — Griffin & Szipl, P.C.

(57) ABSTRACT

The invention embodies the turret (10) as a protected cell (1) with its own protective plates (7) and then provides this with an additional casing of protective plates (9) so that both together implement a modular protective construction with different levels of protection. Outside the protected cell (1), assemblies (2) can be arranged that do not need to be within the direct reach of the operator. This can be in addition to the ammunition, the electronics for the ammunition feed, and also the electronics of the turret control or the like. These assemblies (2) are again encased by a lattice structure (8) that serves as an accommodation possibility for other protective elements (9) that form the outer skin of the turret (10).

19 Claims, 2 Drawing Sheets

U.S. PATENT DOCUMENTS

| | | | | | |
|---|---|---|---|---|---|
| 4,391,179 | A | | 7/1983 | Tidstrom | |
| 4,398,446 | A | | 8/1983 | Pagano et al. | |
| 4,417,499 | A | * | 11/1983 | Grosser et al. | 89/36.13 |
| 4,429,616 | A | * | 2/1984 | Grosser | 89/36.13 |
| 4,448,107 | A | | 5/1984 | Kotai et al. | |
| 4,524,674 | A | * | 6/1985 | Gilvydis | 89/36.08 |
| 4,568,104 | A | * | 2/1986 | LeBlanc | 280/771 |
| 4,576,085 | A | | 3/1986 | LeBlanc | |
| 4,593,600 | A | * | 6/1986 | Kaustrater | 89/33.1 |
| 4,598,785 | A | * | 7/1986 | LeBlanc | 180/68.1 |
| 4,601,230 | A | | 7/1986 | LeBlanc | |
| 4,607,562 | A | * | 8/1986 | LeBlanc | 89/40.03 |
| 4,632,011 | A | | 12/1986 | Metz et al. | |
| 4,646,616 | A | * | 3/1987 | Svensson | 89/36.14 |
| 4,690,031 | A | * | 9/1987 | Metz et al. | 89/36.13 |
| 4,840,108 | A | | 6/1989 | Hurlemann et al. | |
| 4,864,913 | A | * | 9/1989 | Grunewald et al. | 89/34 |
| 4,951,548 | A | | 8/1990 | Wixon et al. | |
| 4,976,185 | A | | 12/1990 | Wixon et al. | |
| 5,076,138 | A | | 12/1991 | Mannhart et al. | |
| 5,115,713 | A | | 5/1992 | Muller et al. | |
| 5,115,714 | A | | 5/1992 | Muller et al. | |
| 5,218,162 | A | | 6/1993 | Bender-Zanoni | |
| 5,284,082 | A | | 2/1994 | Sprafke et al. | |
| 5,299,487 | A | | 4/1994 | Bertiller et al. | |
| 5,471,904 | A | | 12/1995 | Armstrong | |
| 5,499,568 | A | * | 3/1996 | Turner | 89/36.08 |
| 5,679,918 | A | * | 10/1997 | Korpi et al. | 89/36.08 |
| 5,684,265 | A | | 11/1997 | Strasser et al. | |
| 5,723,807 | A | * | 3/1998 | Kuhn, II | 89/36.02 |
| 5,866,839 | A | | 2/1999 | Ohayon | |
| 5,929,366 | A | | 7/1999 | Kennedy | |
| 6,082,240 | A | * | 7/2000 | Middione et al. | 89/36.08 |
| 6,606,933 | B2 | | 8/2003 | Falk | |
| 6,962,102 | B1 | * | 11/2005 | Johnston et al. | 89/36.17 |
| 7,478,580 | B1 | * | 1/2009 | Parimi et al. | 89/36.13 |
| 2007/0000377 | A1 | * | 1/2007 | Ohnstad | 89/36.13 |
| 2009/0072569 | A1 | * | 3/2009 | Engelbart | 296/39.1 |
| 2009/0114085 | A1 | * | 5/2009 | Diller et al. | 89/36.13 |
| 2009/0120271 | A1 | | 5/2009 | Diller et al. | |
| 2009/0120274 | A1 | * | 5/2009 | Schneider et al. | 89/36.08 |
| 2010/0126337 | A1 | * | 5/2010 | Carter | 89/36.02 |

FOREIGN PATENT DOCUMENTS

| | | | |
|---|---|---|---|
| DE | 79 15 552 | U1 | 11/1979 |
| DE | 255 67 22 | C1 | 7/1988 |
| DE | 39 31 895 | A1 | 12/1994 |
| DE | 44 26 082 | A1 | 1/1995 |
| DE | 195 26 664 | A1 | 1/1997 |
| DE | 196 52 678 | C1 | 3/1998 |
| DE | 2804630 | C1 | 11/1999 |
| DE | 10160216 | C1 | 6/2003 |
| DE | 699 04 419 | T2 | 8/2003 |
| DE | 697 28 353 | T2 | 8/2004 |
| DE | 10 2004058 442 | A1 | 7/2005 |
| DE | 10 2004 031 773 | B3 | 1/2006 |
| DE | 10 2005 020 657 | A1 | 2/2006 |
| EP | 0 989 379 | A1 | 3/2000 |
| EP | 0840085 | A3 | 4/2000 |
| EP | 1 424 534 | A3 | 11/2004 |
| FR | 2 863 350 | | 6/2005 |
| WO | 2005/088233 | A1 | 9/2005 |
| WO | 2008/109140 | A1 | 9/2008 |
| WO | 2008109140 | A1 | 9/2008 |

OTHER PUBLICATIONS

Office Action issued in co-peding U.S. Appl. No. 12/202,698 dated Oct. 6, 2010.

U.S Office Action issued in co-pending U.S. Appl. No. 12/202,698 dated Apr. 27, 2011.

Office Action issued in corresponding European Application No. 08 801 678.7, dated Jan. 25, 2011.

U.S. Appl. No. 60/893,611, filed Mar. 7, 2007.

* cited by examiner

MODULAR, ADAPTABLE BALLISTIC PROTECTIVE CONSTRUCTION IN PARTICULAR FOR A WEAPONS TURRET

This application claims priority from U.S. Provisional Patent Application No. 60/969,731, filed Sep. 4, 2007, the entire disclosure of which is incorporated herein by reference. This application also claims priority from German Patent Application No. DE 10 2007 041 292.6, filed Aug. 31, 2007, the entire disclosure of which is also incorporated herein by reference.

FIELD OF THE INVENTION

The invention relates to an adaptive, modular, ballistic, protective construction or assembly for individual protection creating different levels of protection, in particular, for a manned turret.

BACKGROUND OF THE INVENTION

Various sandwich structures, or so-called Schott armorings, are known for the protection of a vehicle. Thus, U.S. Pat. No. 4,351,558 A describes a vehicle wall that is itself constructed as a Schott armoring, and is composed of a front plate and a back plate that are mounted at a specified distance from one another. Another Schott armoring can be taken from DE 25 56 722 C1. In the Schott area forming between an outer and an inner armor wall, intermediate armoring elements are arranged that can be mounted and demounted.

DE 79 15 552 U1 is concerned with an armoring with at least one hard outer layer facing A bombardment and at least one softer inner layer in which the armor wall, comprising multilayer steel, is heat-treated. Armoring elements comprising two or more armor plates arranged at a distance from one another are disclosed in DE 28 04 630 C1. Mineral materials are incorporated therein in chambers between the armor plates. WO 2005/088233 A1 relates to an armor plate and a vehicle equipped therewith, whereby a first plate is at a distance of at least 20 mm from a second plate. The second plate, in addition, has a coating of carbon, magnesium, and phosphorus as well as sulfate.

In particular with manned turret embodiments, protection of the crew is specified. In such cases, armor steel is then mounted at least on the turret. The thickness of the steel, or of the protection, is determined thereby depending on the level of protection to be met. However, this requires a turret construction that is spatially larger, whereby the total weight of the vehicle also increases.

Here, the object of the invention is to show a ballistic protection, in particular for a manned turret, in which endeavors are made to reduce the total weight.

SUMMARY OF THE INVENTION

The object is achieved by the features of first embodiment of the invention pertaining to a ballistic protective construction, in particular for the protection of a turret (10) of a combat vehicle, comprising at least two protective walls (11, 12), an inner and an outer protective wall, formed by means of various materials, characterized in that the protective construction is modular and adaptable, whereby (i) the inner protective wall (12) and the outer protective wall (11) in combination create different levels of protection, (ii) the inner protective wall (12) and the outer protective wall (11) possess the same or different levels of protection, and (iii) the level of protection of the outer protective wall (11) is taken into consideration in implementing the level of protection of the inner protective wall (12).

Advantageous embodiments can be taken as follows from the first embodiment. In accordance with a second embodiment of the invention, the first embodiment can be modified so that the inner protective wall (12) protects a protected cell (1) of the turret (10) and the outer protective wall (11) protects the turret (10). In accordance with a third embodiment of the invention, the second embodiment can be modified so that the protected cell (1) accommodates at least one operator's station that is embodied as a self-supporting gas- and pressure-tight welded construction, on which the inner protective wall (12) with corresponding protective elements (7) can be mounted. In accordance with a fourth embodiment of the present invention, the second and/or third embodiments can be further modified so that the outer protective wall (11) can be mounted on a lattice structure (8) disposed around the turret (10) and is formed by outer protective elements (9). In accordance with a fifth embodiment of the invention, the first through fourth embodiments can be further modified so that thin-layered and also thick-layered composite material and/or rubber up to armor steel (i.e., materials selected from the group consisting of rubber, armor steel, and other various materials having properties ranging from those of rubber and those of armor steel) are used as materials.

More generally, the invention is based on the idea of embodying the turret as a protected cell with its own protective armor-plates and then to provide these with an additional casing of protective armor-plates such that both of these together implement a modular protective construction with different levels of protection. Outside the protected cell, assemblies can be arranged that do not need to be within the direct reach of the operator. This can be in addition to the ammunition, the electronics for the ammunition feed, and also the electronics of the turret control, or the like. These components are again encased in a lattice structure that serves for the possible accommodation of further protective elements that form the outer skin of the turret. Such compartmentalization enables the reduction of the inner area of the turret, or of the protected cell, while maintaining the required protection for the operators and reduction of the turret weight.

Depending on the use of the vehicle, the protection for the turret can be adapted individually to the protection needs. The same turret can thus be embodied, altered, or supplemented in level of protection I, II, III, etc. respectively. This increases the usage possibilities of the vehicle, since the vehicle, or the turret, can be used more universally by means of selective alteration and, thus, a change in the different levels of protection. For example, consider the circumstance wherein complete protection for the crew is required, but only a lesser protection for the void space is needed. Accordingly, the outer protective wall has a smaller level of protection than the protected cell. Both protective walls in their totality form the protection for the protected cell. If, in accordance with another deployment of, for example, the same vehicle, a higher degree or level of protection is required for the void space, then the level of protection of the outer protective wall is increased. Consequently, the inner protective wall can be reduced to a lower level of protection because, here too, in total the two protective walls create the required protection of the crew.

A ballistic protective construction made of two shells (protective casings) that can be adapted to the respective protection requirement, and has a graduated degree or level of protection, is thus proposed for the spaces behind the outer skin as well as the weapon cradle and behind the wall of the protected cell. A void space, occurring between the outer skin and wall of the protected cell or the turret, can be used for assemblies that are usually disposed in the turret, as is known.

In a further embodiment of the invention, it is proposed to design the void space between the turret and adaptive armoring for the supply system of the ammunition. To this end an ammunition feed is incorporated into the void space and the ammunition disposed therein is fed directly to the weapon. A known ammunition magazine can then be omitted by these means or design. Protection of the ammunition is created by means of the outer protective wall on the turret. This level of protection can then be less than the level of protection of the protected cell.

Based on the bandwidth in the loading profile, differently dimensioned protective structures result for the different loading profiles so that the weight of the protected turret varies. The components, themselves, are weight-optimized respectively.

BRIEF DESCRIPTION OF THE DRAWINGS

The invention will be described in more detail based on an exemplary embodiment with drawings, which show.

DETAILED DESCRIPTION OF THE INVENTION

Figure 1:
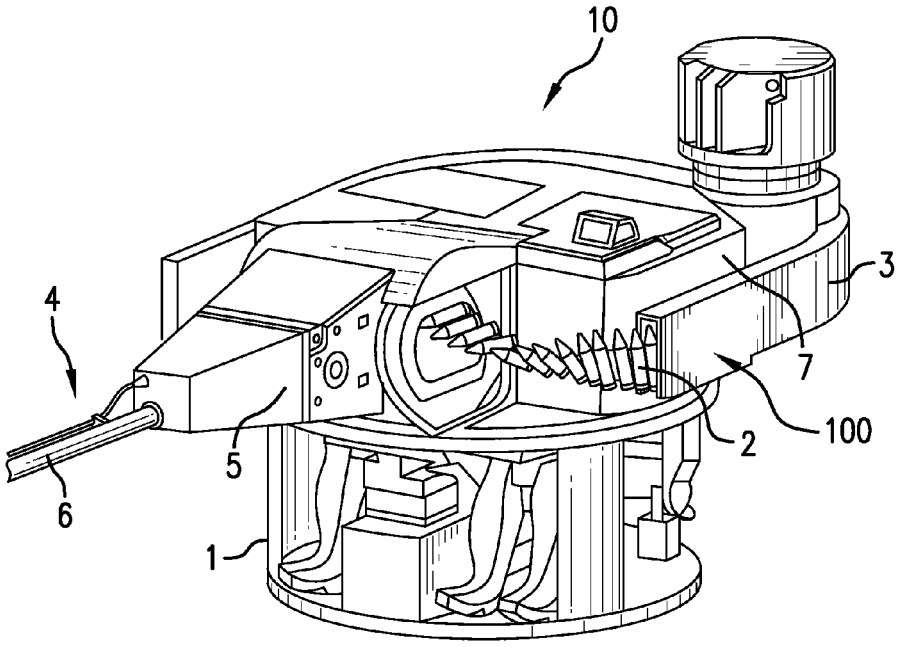
FIG. 1 shows a protected cell with assemblies disposed outside.

FIG. 1 illustrates a protected cell 1 (operator's station) with assemblies disposed outside, such as ammunition 2 of an ammunition supply system 100, which is disposed in a channel 3 around the protected cell 1 and inside this, is fed to a weapon 4. The weapons 4, with cradle 5 and weapon barrel 6, are likewise mounted outside the protected cell 1. The operator's station 1 of the armored turret 10 is embodied as a self-supporting gas-tight and pressure-tight welded construction 50. Appropriate protective elements 7 can be mounted on this self-supporting gas-tight and pressure-tight welded construction 50.

Figure 2:
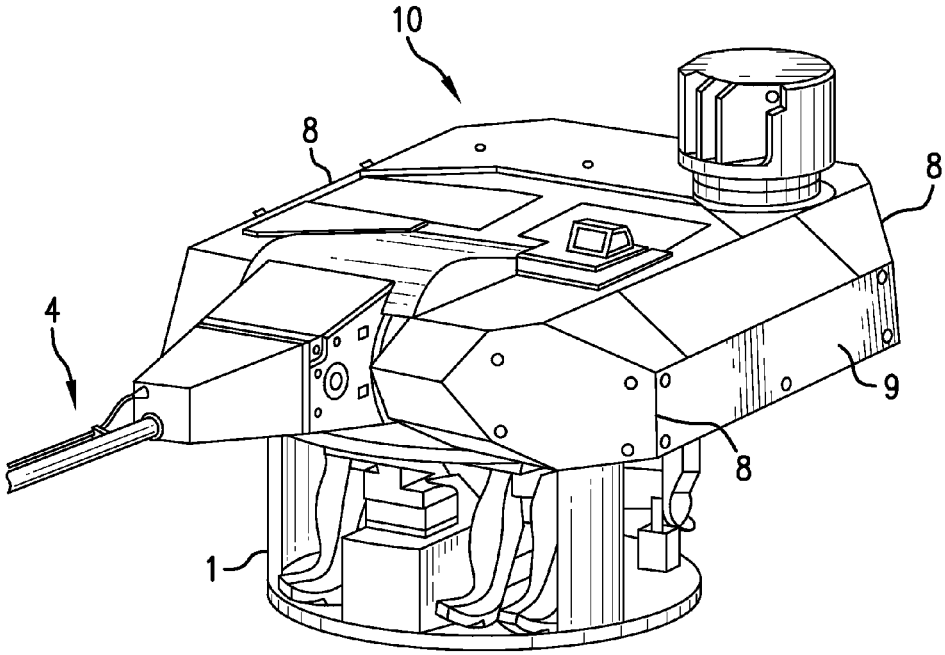
FIG. 2 shows the protected cell from FIG. 1 with a lattice structure disposed outside and protective elements.

FIG. 2 shows the protected cell 1 from FIG. 1 with a lattice structure 8 disposed outside the cell 1 and disposed around the turret 10, and outer protective elements 9, here shown as protective plates, are mounted on the lattice structure 8. A void space 55, occurring between the outer skin 11 and wall 12 of the protected cell 1, can be used for assemblies that are usually disposed in the turret, such as the ammunition supply system 100.

Figure 3:
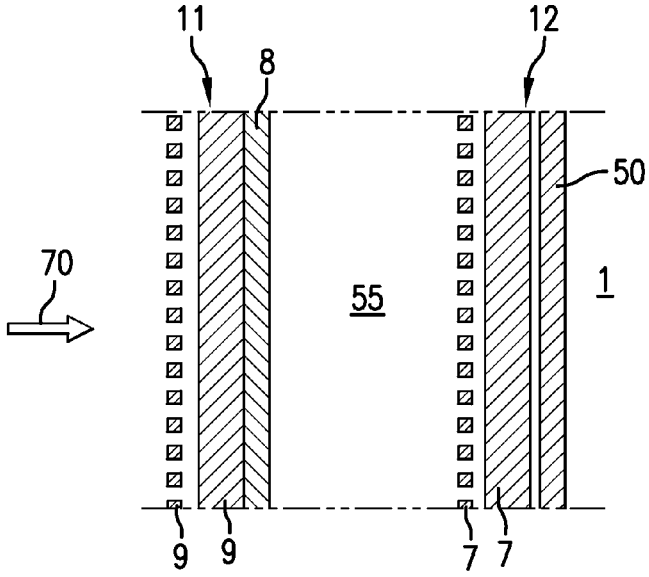
FIG. 3 shows the ballistic protective construction between protected cell and outer wall.

FIG. 3 shows the ballistic protective construction between the protected cell 1 and the lattice structure 8 with the protective elements 9 more in general form: a threat 70 first meets the outer protective casing 11 (i.e., lattice structure 8 provided with the outer protective elements 9 mounted thereon), then the void space 55 that contains ammunition 2, and only then the inner protective casing 12 and, thus, the welded construction 50 of the protected cell 1 itself. The previously disposed protective elements 9 of the outer protective casing 11 are taken into consideration in designing the protective elements 7 of the protected cell 1. By these means, different levels of protection can be adapted individually in coordination with the two protective casings 11, 12, and the required protection needs can be taken into consideration, as shown in FIG. 4.

Figure 4:
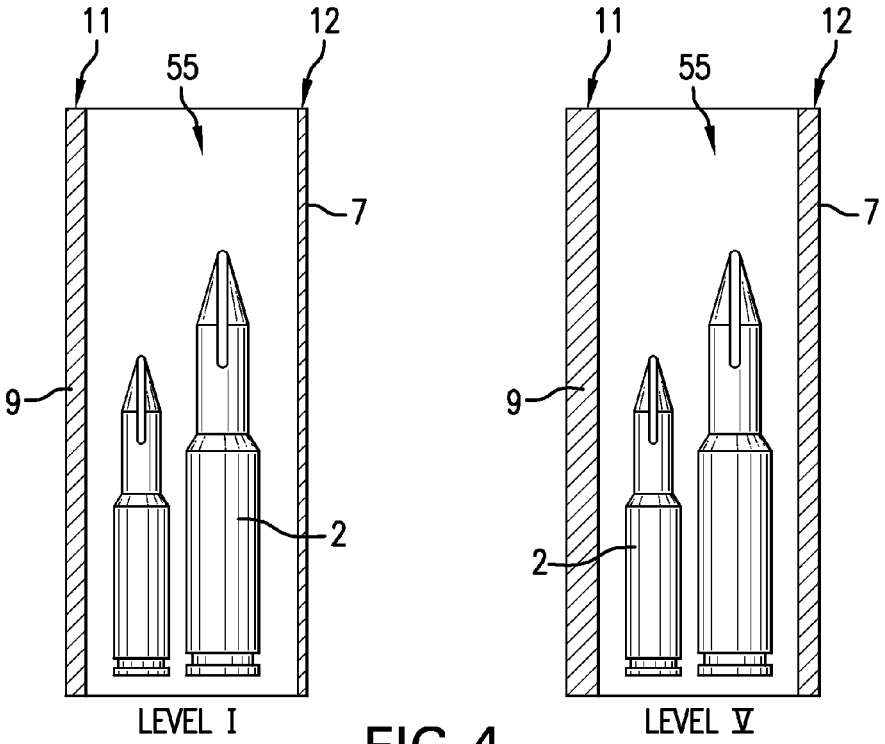
FIG. 4 shows the modular protective constructions.

FIG. 4 shows two of the following embodied variants of the implementation possibility for the creation of different levels of protection in accordance with the present invention. In accordance with variant I, a level of protection 1/2, the outer wall 11 (=protective element 9), for example, comprises a thin-layered composite material (e.g. a thin-layered ceramic), and the inner wall 12 (=protected cell 1) comprises armor steel. In accordance with variant II of the invention, a level of protection 1/3, the outer wall 11 comprises a thin-layered composite material, and the inner wall 12 comprises a thin-layered rubber and/or a thin-layered ceramic as well as armor steel. In accordance with variant III of the invention, a level of protection 3/4, the outer wall 11 comprises a thin-layered rubber and/or a thin-layered composite material as well as armor steel, and the inner wall 12 comprises an armor steel. In accordance with variant IV of the invention, a level of protection 3/5, the outer wall 11 again comprises a thin-layered rubber and/or a thin-layered composite material as well as armor steel, and the inner wall 12 comprises a thin-layered composite material and armor steel. In accordance with variant V of the invention, a level of protection 4/5, the highest level of protection is set, for example. For variant V, the outer wall 11 comprises a thick-layered rubber and/or a thick-layered composite formed material, while the inner wall 12 comprises thick armor steel and one or both of a thin-layered rubber and a thin-layered composite material.

In accordance with the present invention, protection levels are defined as follows. The level of protection for the outer wall 11 and the inner wall 12 may each vary from 1 to 5 in accordance with the variants I to V described above. A "level of protection" rating of "1/3" means that the outer wall 11 provides a protection level of "1" and the inner wall 12 provides a protection level of "3." Likewise, a "level of protection" rating of "4/5" means that the outer wall 12 provides a protection level of "4" and the inner wall provides a protection rating of "5." A person of ordinary skill in the art would, therefore, understand how to implement the protection level rating scheme employed herein so as to understand what is meant by a "level of protection" of "1/3," "3/4" and "3/5," and so on. Furthermore, as evident from variants I to V above, (i) a protection rating of "1" corresponds to a wall comprised of a thin-layered composite material (e.g. a thin-layered ceramic), (ii) a protection rating of "2" corresponds to a wall comprised of thin armor steel, (iii) a protection rating of "3" corresponds to a wall comprised of thin armor steel plus a thin-layered rubber and/or a thin-layered composite material (e.g., ceramic), (iv) a protection rating of "4" corresponds to a wall comprised of thick armor steel or of a thick-layered rubber and/or a thick-layered composite formed material, and (v) a protection rating of "5" corresponds to a wall comprised of thick armor steel plus one or more of a thin-layered composite material and a thin-layered rubber material.

The above explicitly described variant forms are, therefore, only a small number of a large selection of combinations. Additional permutations of combinations of outer wall and inner wall materials are within the scope of the present invention as would be understood by a person of ordinary skill in the art.

In accordance with the present invention, a method embodiment is also described. In accordance with a first method embodiment of the invention, a method for protecting the turret of a combat vehicle by using a ballistic protective construction is provided that includes the steps of: (a) providing the ballistic protective construction comprising at least two protective walls including an inner protective wall and an outer protective wall formed by one or a plurality of materials, wherein the protective construction is modular and adaptable, and wherein (i) the inner protective wall and the outer protective wall, in combination, create different levels of protection for a turret of a combat vehicle, (ii) the inner protective wall and the outer protective wall possess the same or different levels of protection, and (iii) a first level of protection provided by the outer protective wall is taken into consideration in implementing a second level of protection provided by the inner protective wall; and (b) arranging the protective construction so as to protect the turret of the combat vehicle, wherein the first level of protection provided by the outer protective wall is considered when selecting the second level of protection provided by the inner protective wall so as to provide a combined protection rating for the turret.

In accordance with a second method embodiment of the invention, the first method embodiment may be further modified so that the combined protection rating for the turret is X/Y, wherein protective rating X ranges from 1 to 5 and protective rating Y ranges from 1 to 5. In accordance with third method embodiment, the second method embodiment may be further modified so that the protective rating X corresponds to the first level of protection provided by the inner protective wall and the protective rating Y corresponds to the second level of protection provided by the outer protective wall, wherein the inner protective wall protects a protected cell disposed in the turret and the outer protective wall protects the turret. In accordance with a fourth method embodiment of the invention, the third method embodiment is further modified so that the protective rating X is less than the protective rating Y. The fourth method embodiment is a preferred embodiment because it allows for a reduction in the weight of the ballistic protective construction due to the fact that only the protected cell, where the combat vehicle operator is located, is provided with the most protection.

As evident from the apparatus and method embodiments of the invention described above, the inner protective wall 11 and the outer protective wall 12 may be constructed of one or more of the following materials: thin-layered rubber material, thin-layered composite material, thin (light-weight) armor, thick-layered rubber material, thick-layered composite material, and thick (heavy-weight) armor.

The invention claimed is:

1. A ballistic protective construction disposed to protect a turret of a combat vehicle, wherein the ballistic protective construction comprises at least two protective walls including an inner protective wall and an outer protective wall formed by one or a plurality of materials, wherein the protective construction is modular and adaptable, and wherein (i) the inner protective wall is disposed to provide a first level of protection for the turret and the outer protective wall is disposed to provide a second level of protection for a void space formed between the inner protective wall and the outer protective wall, wherein, in combination, the inner protective wall and the outer protective wall provide a third level of protection for the turret;

(ii) the first level of protection provided by the inner protective wall and the second level of protection provided by the outer protective wall are the same or are different levels of protection; and (iii) the first level of protection of the inner protective wall is selected based on the second level of protection of the outer protective wall, wherein the inner protective wall is arranged to protect a protected cell of the turret and the outer protective wall is arranged to protect the turret and the void space, wherein the protected cell accommodates at least one operator's station that is embodied as a self-supporting gas-tight and pressure-tight welded construction, and the inner protective wall comprises a plurality of protective elements mounted on the self-supporting gas-tight and pressure-tight welded construction, wherein the outer protective wall is mounted on a lattice structure disposed around the turret and the outer protective wall is formed by a plurality of outer protective elements, and wherein an ammunition supply system is disposed in the void space and is protected by the outer protective wall, wherein the ammunition supply system comprises an ammunition feed and ammunition.

2. A ballistic protective construction according to claim 1, wherein thin-layered and also thick-layered composite material, or rubber and armor steel, or thin-layered and also thick-layered composite material and rubber and armor steel, are used as the one or plurality of materials used to form the inner protective wall and the outer protective wall.

3. A ballistic protective construction according to claim 1, wherein the ballistic protective construction is adaptable to provide five variant levels of protection for the third level of protection, wherein a. in order to adapt the third level of protection to a first variant level of protection, the outer protective wall is adapted so that the outer protective elements comprise a thin-layered composite material and the inner protective wall is adapted so that the protected cell comprises armor steel;

b. in order to adapt the third level of protection to a second variant level of protection, the outer protective wall is adapted so that the outer protective elements comprise the thin-layered composite material and the inner protective wall is adapted so that the protected cell comprises armor steel and a second material comprising a thin-layered rubber, or a thin-layered ceramic, or the thin-layered rubber and the thin-layered ceramic;

c. in order to adapt the third level of protection to a third variant level of protection, the outer protective wall is adapted so that the outer protective elements comprise armor steel and a third material comprising the thin-layered rubber, or the thin-layered composite material, or the thin-layered rubber and the thin-layered composite material, and the inner protective wall is adapted so that the protected cell comprises armor steel;

d. in order to adapt the third level of protection to a fourth variant level of protection, the outer protective wall is adapted so that the outer protective elements comprise armor steel and the third material comprising the thin-layered rubber, or the thin-layered composite material, or the thin-layered rubber and the thin-layered composite material, and the inner protective wall is adapted so that the protected cell comprises armor steel and the thin-layered composite material; and e. in order to adapt the third level of protection to a fifth variant level of protection, the outer protective wall is adapted so that the outer protective elements comprise a thick-layered rubber, or a thick-layered composite material, or the thick-layered rubber and the thick-layered composite material, and the inner protective layer is adapted so that the protected cell comprises the third material comprising the thin-layered rubber, or the thin-layered composite material, or the thin-layered rubber and the thin-layered composite material.

4. A ballistic protective construction according to claim 1, wherein electronics for the ammunition feed are disposed in the void space and are protected by the outer protective wall.

5. A method for protecting a turret of a combat vehicle by using a ballistic protective construction, comprising the steps of:

(A) providing the ballistic protective construction comprising at least two protective walls including an inner protective wall and an outer protective wall formed by one or a plurality of materials, wherein the protective construction is modular and adaptable, and wherein (i) the inner protective wall provides a first level of protection and the outer protective wall provides a second level of protection, wherein, in combination, the inner protective wall and the outer protective wall provides a third level of protection for the turret of the combat vehicle;

(ii) the first level of protection provided by the inner protective wall and the second level of protection provided by the outer protective wall are the same or are different levels of protection; and (iii) the first level of protection provided by the inner protective wall is selected based on the second level of protection provided by the outer protective wall;

(B) arranging the protective construction so as to protect the turret of the combat vehicle, wherein the inner protective wall is arranged to provide the first level of protection for the turret and the outer protective wall is arranged to provide the second level of protection for a void space formed between the inner protective wall and the outer protective wall, and wherein, in combination, the inner protective wall and the outer protective wall provide the third level of protection for the turret, wherein the second level of protection provided by the outer protective wall is considered when selecting the first level of protection provided by the inner protective wall so as to provide the third level of protection as a combined protection rating for the turret, wherein an ammunition supply system is disposed in the void space and the outer protective wall is arranged to protect the ammunition supply system, wherein the ammunition supply system comprises an ammunition feed and ammunition.

6. A method according to claim 5, wherein the outer protective wall is mounted on a lattice structure disposed around the turret and the outer protective wall is formed by a plurality of outer protective elements.

7. A method according to claim 6, wherein thin-layered and also thick-layered composite material, or rubber and armor steel, or thin-layered and also thick-layered composite material and rubber and armor steel, are used as the one or plurality of materials used to form the inner protective wall and the outer protective wall.

8. A method according to claim 5, wherein thin-layered and also thick-layered composite material, or rubber and armor steel, or thin-layered and also thick-layered composite material and rubber and armor steel, are used as the one or plurality of materials used to form the inner protective wall and the outer protective wall of the ballistic protective construction.

9. A ballistic method according to claim 5, wherein the outer protective wall comprises a plurality of outer protective elements mounted on a lattice structure of the ballistic protective construction.

10. A method according to claim 9, wherein thin-layered and also thick-layered composite material, or rubber and armor steel, or thin-layered and also thick-layered composite material and rubber and armor steel, are used as the one or plurality of materials used to form the inner protective wall and the outer protective wall of the ballistic protective construction.

11. A method according to claim 9, wherein the inner protective wall comprises a plurality of protective elements of a protected cell mounted on at least one operator's station accommodated by the protective cell, wherein the at least one operator's station has a self-supporting gas-tight and pressure-tight welded construction.

12. A method according to claim 5, wherein the combined protection rating for the turret is X/Y, wherein protective rating X ranges from 1 to 5 and protective rating Y ranges from 1 to 5.

13. A method according to claim 12, wherein the protective rating X corresponds to the first level of protection provided by the inner protective wall and the protective rating Y corresponds to the second level of protection provided by the outer protective wall, wherein the inner protective wall is arranged to protect a protected cell disposed in the turret and the outer protective wall is arranged to protect the turret and the void space.

14. A method according to claim 13, wherein the protective rating X is less than the protective rating Y.

15. A method according to claim 5, wherein the outer protective wall comprises a plurality of outer protective elements mounted on a lattice structure, and wherein the inner protective wall comprises a plurality of protective elements of a protected cell mounted on a self-supporting gas-tight and pressure-tight welded construction, wherein the method includes the step of:

(C) adapting the ballistic protective construction to provide one of five variant levels of protection for the third level of protection, wherein a. in order to adapt the third level of protection to a first variant level of protection, the outer protective wall is adapted so that the outer protective elements comprise a thin-layered composite material and the inner protective wall is adapted so that the protected cell comprises armor steel;

b. in order to adapt the third level of protection to a second variant level of protection, the outer protective wall is adapted so that the outer protective elements comprise the thin-layered composite material and the inner protective wall is adapted so that the protected cell comprises armor steel and a second material comprising a thin-layered rubber, or a thin-layered ceramic, or the thin-layered rubber and the thin-layered ceramic;

c. in order to adapt the third level of protection to a third variant level of protection, the outer protective wall is adapted so that the outer protective elements comprise armor steel and a third material comprising the thin-layered rubber, or the thin-layered composite material, or the thin-layered rubber and the thin-layered composite material, and the inner protective wall is adapted so that the protected cell comprises armor steel;

d. in order to adapt the third level of protection to a fourth variant level of protection, the outer protective wall is adapted so that the outer protective elements comprise armor steel and the third material comprising the thin-layered rubber, or the thin-layered composite material, or the thin-layered rubber and the thin-layered composite material, and the inner protective wall is adapted so that the protected cell comprises armor steel and the thin-layered composite material; and e. in order to adapt the third level of protection to a fifth variant level of protection, the outer protective wall is adapted so that the outer protective elements comprise a thick-layered rubber, or a thick-layered composite material, or the thick-layered rubber and the thick-layered composite material, and the inner protective layer is adapted so that the protected cell comprises the third material comprising the thin-layered rubber, or the thin-layered composite material, or the thin-layered rubber and the thin-layered composite material.

16. A ballistic protective construction according to claim 5, wherein electronics for the ammunition feed are disposed in the void space and are protected by the outer protective wall.

17. A combat vehicle comprising:

(a) a turret;

(b) a ballistic protective construction disposed to protect the turret of the combat vehicle, wherein the ballistic protective construction comprises at least two protective walls including an inner protective wall and an outer protective wall formed by one or a plurality of materials, wherein the protective construction is modular and adaptable, and wherein (i) the inner protective wall is disposed to provide a first level of protection for the turret and the outer protective wall is disposed to provide a second level of protection for a void space formed between the inner protective wall and the outer protective wall, wherein, in combination, the inner protective wall and the outer protective wall provide a third level of protection for the turret;

(ii) the first level of protection provided by the inner protective wall and the second level of protection provided by the outer protective wall are the same or are different levels of protection; and (iii) the first level of protection of the inner protective wall is selected based on the second level of protection of the outer protective wall, wherein the inner protective wall is arranged to protect a protected cell of the turret and the outer protective wall is arranged to protect the turret and the void space, wherein the protected cell accommodates at least one operator's station that is embodied as a self-supporting gas-tight and pressure-tight welded construction, and the inner protective wall comprises a plurality of protective elements mounted on the self-supporting gas-tight and pressure-tight welded construction, wherein the outer protective wall is mounted on a lattice structure disposed around the turret and the outer protective wall is formed by a plurality of outer protective elements;

(c) a weapon mounted outside the protected cell; and (d) an ammunition supply system disposed in the void space and protected by the outer protective wall, wherein the ammunition supply system comprises an ammunition feed and ammunition, and wherein the ammunition supply system feeds ammunition directly to the weapon.

18. A combat vehicle according to claim 17, wherein thin-layered and also thick-layered composite material, or rubber and armor steel, or thin-layered and also thick-layered composite material and rubber and armor steel, are used as the one or plurality of materials used to form the inner protective wall and the outer protective wall of the ballistic protective construction.

19. A ballistic protective construction according to claim 17, wherein electronics for the ammunition feed are disposed in the void space and are protected by the outer protective wall.

* * * * *